US011304489B2

(12) United States Patent
Sierra

(10) Patent No.: US 11,304,489 B2
(45) Date of Patent: Apr. 19, 2022

(54) SALON CHEMICAL DISPENSING ASSEMBLY

(71) Applicant: Luis Sierra, Summit, NJ (US)

(72) Inventor: Luis Sierra, Summit, NJ (US)

( * ) Notice: Subject to any disclaimer, the term of this patent is extended or adjusted under 35 U.S.C. 154(b) by 434 days.

(21) Appl. No.: 16/414,883

(22) Filed: May 17, 2019

(65) Prior Publication Data

US 2020/0359765 A1 Nov. 19, 2020

(51) Int. Cl.

| | |
|---|---|
| ***A45D 24/22*** | (2006.01) |
| ***A45D 24/28*** | (2006.01) |
| ***A46B 11/00*** | (2006.01) |
| ***A45D 19/02*** | (2006.01) |

(52) U.S. Cl.

CPC ..... *A45D 24/28* (2013.01); *A45D 19/02* (2013.01); *A46B 11/002* (2013.01); *A46B 2200/1046* (2013.01)

(58) Field of Classification Search

CPC ..... A45D 2019/0033; A45D 19/0041; A45D 19/0066; A45D 19/0083; A45D 19/02; A45D 19/026; A45D 24/22; A45D 24/26; A45D 24/28; A45D 24/10; A46B 11/002

See application file for complete search history.

(56) References Cited

U.S. PATENT DOCUMENTS

| | | | | |
|---|---|---|---|---|
| 2,571,701 | A * | 10/1951 | Forrester | A45D 24/10 132/265 |
| 5,909,737 | A * | 6/1999 | Ricco | A46B 11/0017 132/116 |
| 7,011,468 | B1 * | 3/2006 | Leventhal | A45D 19/02 132/116 |
| 7,055,528 | B2 | 6/2006 | Shah | |
| 7,063,090 | B2 | 6/2006 | Wang | |
| 7,334,583 | B2 | 2/2008 | Niv | |
| D634,935 | S | 3/2011 | Kobke | |
| 8,109,278 | B2 | 2/2012 | Lee | |
| 8,448,349 | B2 | 5/2013 | Kloeppel-Riech | |
| 2008/0210251 | A1 * | 9/2008 | Dallianis | A45D 24/26 132/116 |
| 2010/0186762 | A1 * | 7/2010 | Spagnuolo | A45D 34/042 132/115 |
| 2014/0311509 | A1 | 10/2014 | Antons | |

FOREIGN PATENT DOCUMENTS

| | | |
|---|---|---|
| WO | WO 2012/125405 A1 * | 9/2012 |
| WO | WO2012150799 | 11/2012 |

* cited by examiner

*Primary Examiner* — Rachel R Steitz

(57) ABSTRACT

A salon chemical dispensing assembly for storing a selectively dispensing a fluid salon treatment includes a bottle for storing a fluid salon treatment. A pumping unit is removably coupled to the bottle to urge the fluid salon treatment outwardly from the bottle when the pumping unit is turned on. A dispensing nozzle is removably coupled to the pumping unit and the fluid salon treatment in the bottle is pumped into the dispensing nozzle thereby facilitating the dispensing nozzle to dispense the fluid salon treatment. A pick housing is movably coupled to the bottle and a pick is slidably positioned in the pick housing. The pick is positionable in a stored position having the pick being retracted into the pick housing. The pick is positionable in a deployed position having the pick extending outwardly from the pick housing.

7 Claims, 4 Drawing Sheets

SALON CHEMICAL DISPENSING ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dispensing devices and more particularly pertains to a new dispensing device for storing a dispensing a fluid salon treatment.

BRIEF SUMMARY OF THE INVENTION

An embodiment of the disclosure meets the needs presented above by generally comprising a bottle for storing a fluid salon treatment. A pumping unit is removably coupled to the bottle to urge the fluid salon treatment outwardly from the bottle when the pumping unit is turned on. A dispensing nozzle is removably coupled to the pumping unit and the fluid salon treatment in the bottle is pumped into the dispensing nozzle thereby facilitating the dispensing nozzle to dispense the fluid salon treatment. A pick housing is movably coupled to the bottle and a pick is slidably positioned in the pick housing. The pick is positionable in a stored position having the pick being retracted into the pick housing. The pick is positionable in a deployed position having the pick extending outwardly from the pick housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
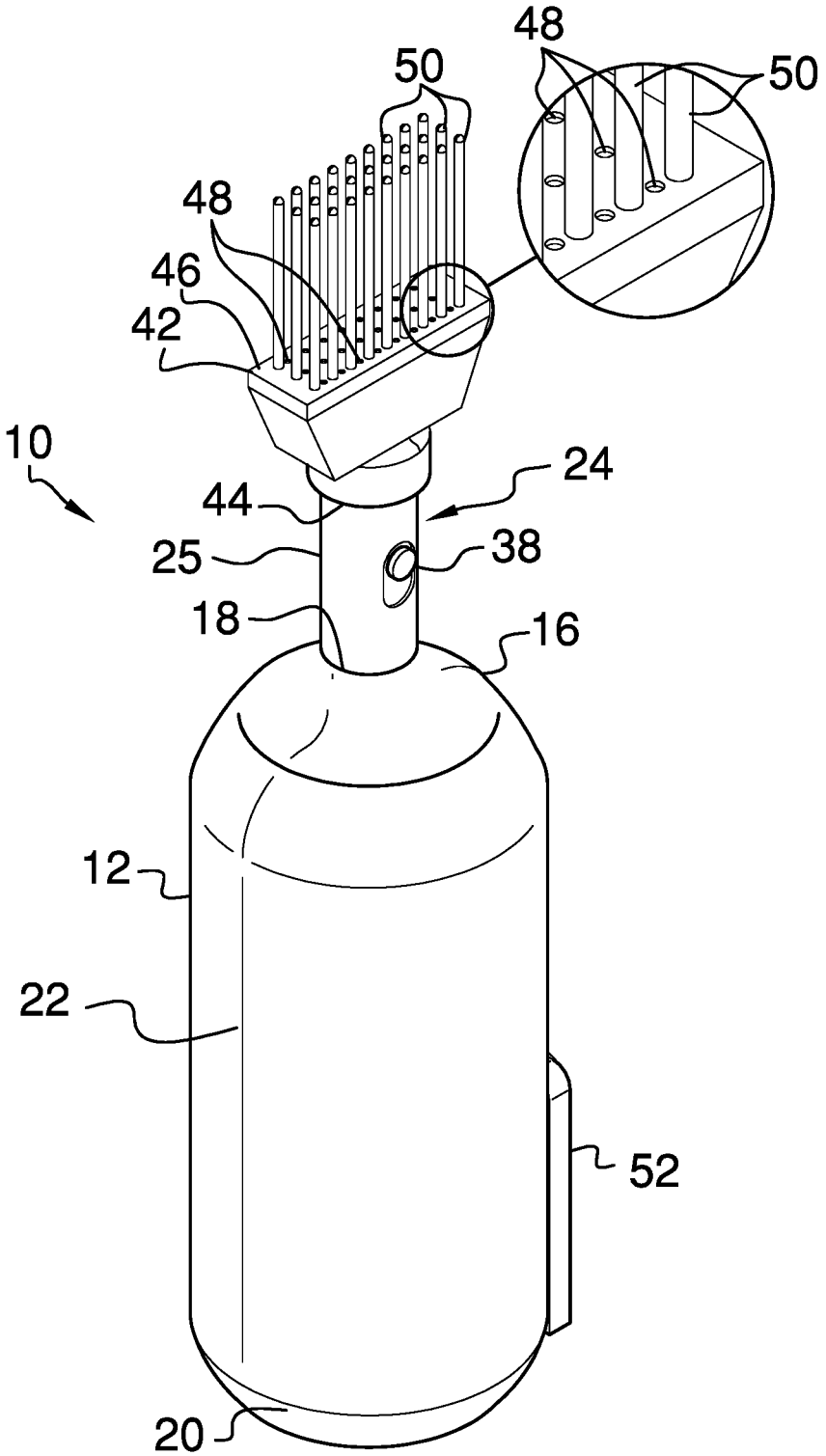
FIG. 1 is a front perspective view of a salon chemical dispensing assembly according to an embodiment of the disclosure.
Figure 2:
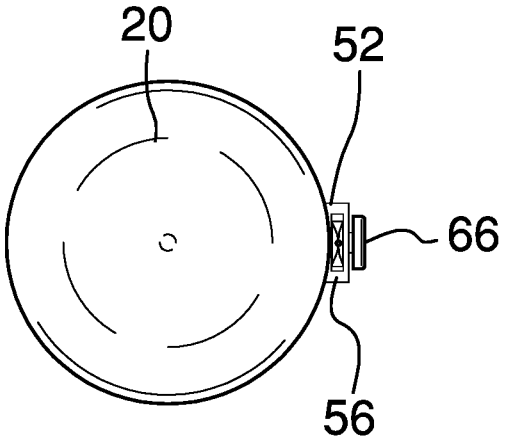
FIG. 2 is a bottom view of an embodiment of the disclosure.
Figure 3:
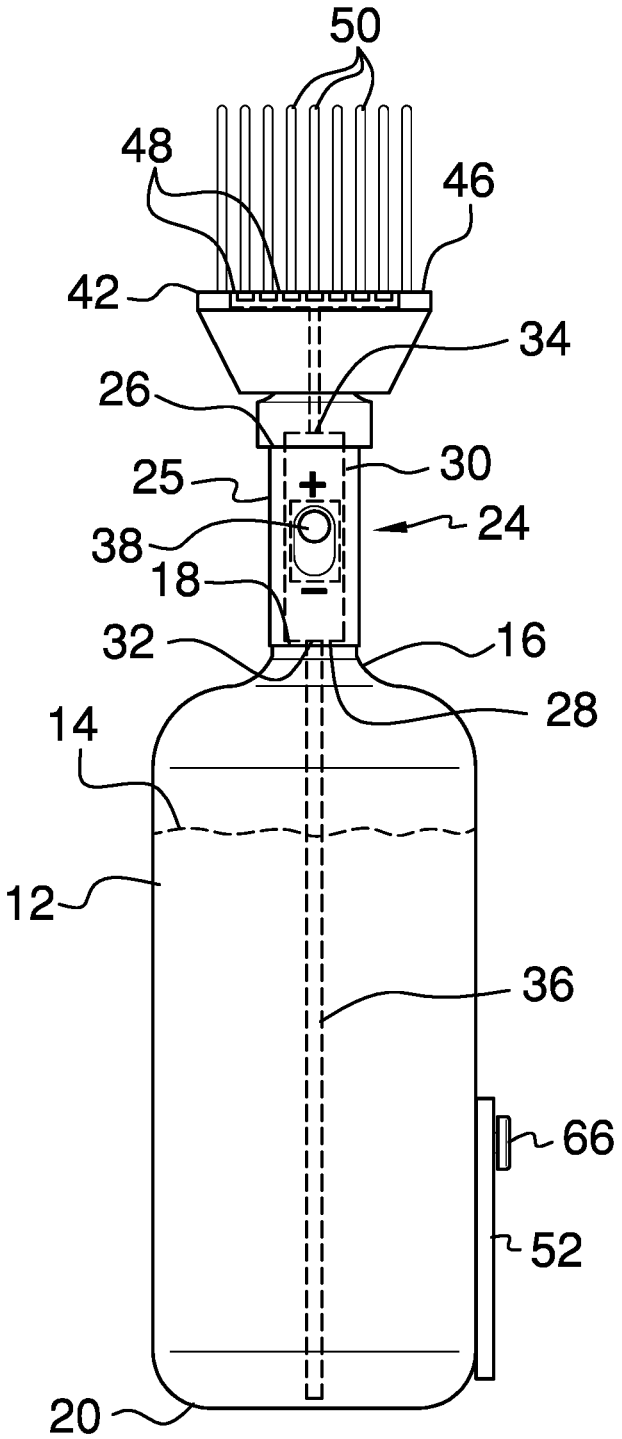
FIG. 3 is a front phantom view of an embodiment of the disclosure.
Figure 4:
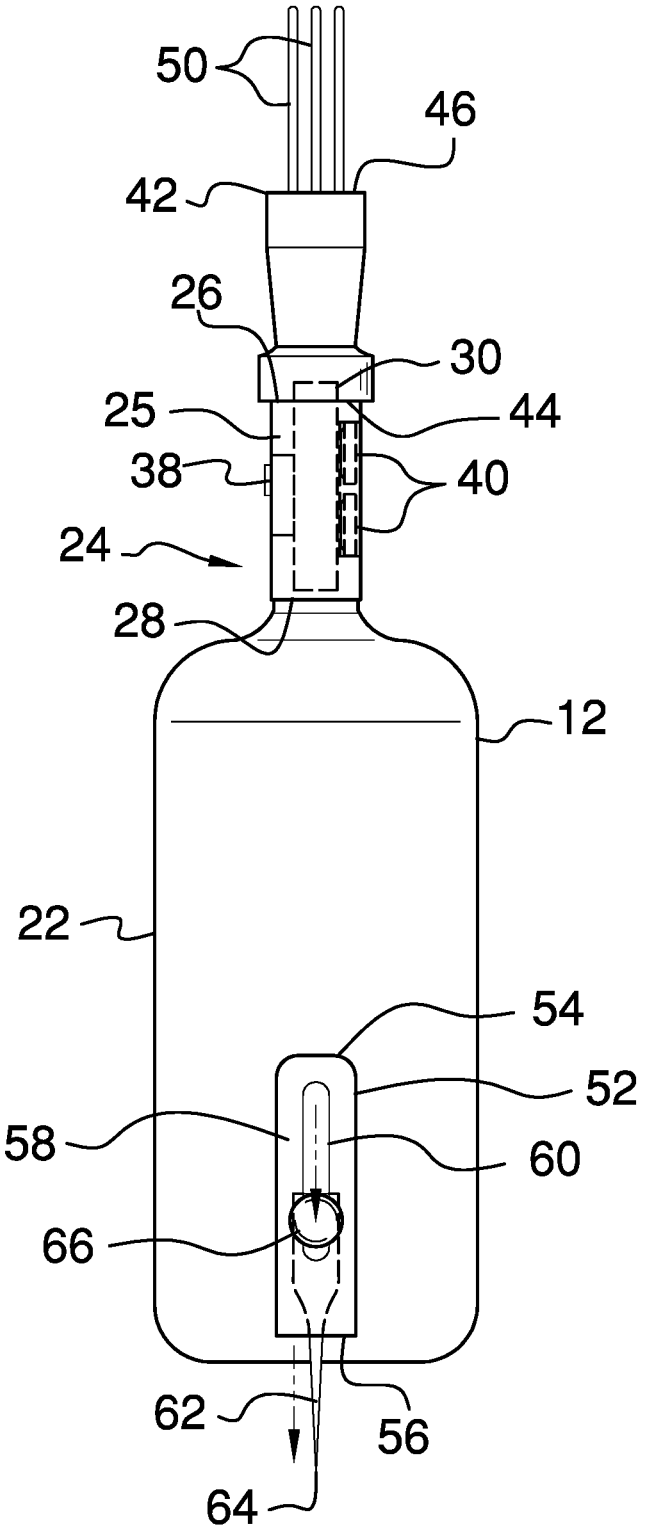
FIG. 4 is a right side phantom view of an embodiment of the disclosure.

With reference now to the drawings, and in particular to FIGS. 1 through 5 thereof, a new dispensing device embodying the principles and concepts of an embodiment of the disclosure and generally designated by the reference numeral 10 will be described.

As best illustrated in FIGS. 1 through 5, the salon chemical dispensing assembly 10 generally comprises a bottle 12 for storing a fluid salon treatment 14. The fluid salon treatment 14 may be hair dye, hair curling solution or any other fluid typically employed in the cosmetology industry. The bottle 12 has a neck 16, a top end 18, a bottom end 20 and an outer wall 22, and the top end 18 is open into an interior of the bottle 12. Additionally, the bottle 12 may have a height of approximately 10.0 inches and a diameter of approximately 3.0 inches.

A pumping unit 24 is provided and the pumping unit 24 is removably coupled to the bottle 12. The pumping unit 24 is in fluid communication with the bottle 12 when the pumping unit 24 is coupled to the bottle 12 to urge the fluid salon treatment 14 outwardly from the bottle 12 when the pumping unit 24 is turned on. The pumping unit 24 comprises a tube 25 that has an upper end 26 and a lower end 28; the upper end 26 insertably receives the top end 18 of the bottle 12. A pump 30 is positioned within the tube 25 and the pump 30 has an inlet 32 and an outlet 34. The pump 30 may be an electric fluid pump or the like.

A pipe 36 is fluidly coupled to the inlet 32 of the pump 30 and the pipe 36 extends downwardly from the tube 25. Thus, the pipe 36 is submerged in the fluid salon treatment 14 when the tube 25 is positioned on the bottle 12. Additionally, the pump 30 produces suction in the pipe 36 when the pump 30 is turned on to pump 30 the fluid salon treatment 14 upwardly through the pipe 36 and outwardly through the outlet 34 of the pump 30. A switch 38 is slidably coupled to the tube 25 and the switch 38 is electrically coupled to the pump 30 for turning the pump 30 on and off. A power supply 40 is positioned within the tube 25, the power supply 40 is electrically coupled to the switch 38 and the power supply 40 comprises at least one battery.

A dispensing nozzle 42 is provided and the dispensing nozzle 42 is removably coupled to the pumping unit 24. The dispensing nozzle 42 is in fluid communication with the bottle 12 when the dispensing nozzle 42 is removably coupled to the pumping unit 24 and when the pumping unit 24 is coupled to the bottle 12. In this way the fluid salon treatment 14 in the bottle 12 is pumped into the dispensing nozzle 42 thereby facilitating the dispensing nozzle 42 to dispense the fluid salon treatment 14.

The dispensing nozzle 42 has a lower end 44 and a top end 46, and lower end 44 of the dispensing nozzle 42 is rounded and is open. The dispensing nozzle 42 flares outwardly between the lower 44 and top 46 ends such that the top end 46 of the dispensing nozzle 42 has an elongated width. The lower end 44 of the dispensing nozzle 42 insertably receives the upper end 26 of the tube 25 such that the lower end 44 of the dispensing nozzle 42 is in fluid communication with the outlet 34 of the pump 30. The top end 46 of the dispensing nozzle 42 has a plurality of dispensing apertures 48 each extending into an interior of the dispensing nozzle 42 and the fluid salon treatment 14 flows outwardly through the dispensing apertures 48 when the pump 30 is turned on. The dispensing apertures 48 are spaced apart from each other and are arranged into a plurality of rows each extending along an entire width of the top end 46 of the dispensing nozzle 42.

A plurality of bristles 50 is each of the bristles 50 is coupled to and extends away from the dispensing nozzle 42. Each of the bristles 50 can penetrate hair on a person's head thereby facilitating the fluid salon treatment 14 to be dispensed among the hair on the person's head. In this way the bristles 50 facilitate the fluid salon treatment 14 to be evenly applied to the hair on the user's head. Each of the bristles 50 is positioned on the top end 46 of the dispensing nozzle 42. Each of the bristles 50 is arranged into a plurality of rows that is each interlaced with the plurality of rows of dispensing apertures 48.

A pick housing 52 is provided and the pick housing 52 is movably coupled to the bottle 12. The pick housing 52 has a top end 54, a bottom end 56 and a forward wall 58 extending therebetween. The forward wall 58 is distally positioned with respect to the outer wall 22 of the bottle 12 and the bottom end 56 of the pick housing 52 is open. Additionally, the bottom end 56 of the pick housing 52 is aligned with the bottom end 20 of the bottle 12. The forward wall 58 has a slot 60 extending into an interior of the pick housing 52 and the slot 60 extends substantially between the top 54 and bottom 56 ends of the pick housing 52.

A pick 62 is slidably positioned in the pick housing 52. The pick 62 is positionable in a stored position having the pick 62 being retracted into the pick housing 52. Conversely, the pick 62 is positionable in a deployed position having the pick 62 extending outwardly from the pick housing 52. In this way the pick 62 can be inserted between hairs on the person's head for spreading hairs apart or the like. The pick 62 has a bottom end 64, the bottom end 64 of the pick 62 tapers to a point and the bottom end 64 of the pick 62 extends outwardly from the bottom end 56 of the pick housing 52 when the pick 62 is positioned in the deployed position.

Figure 5:
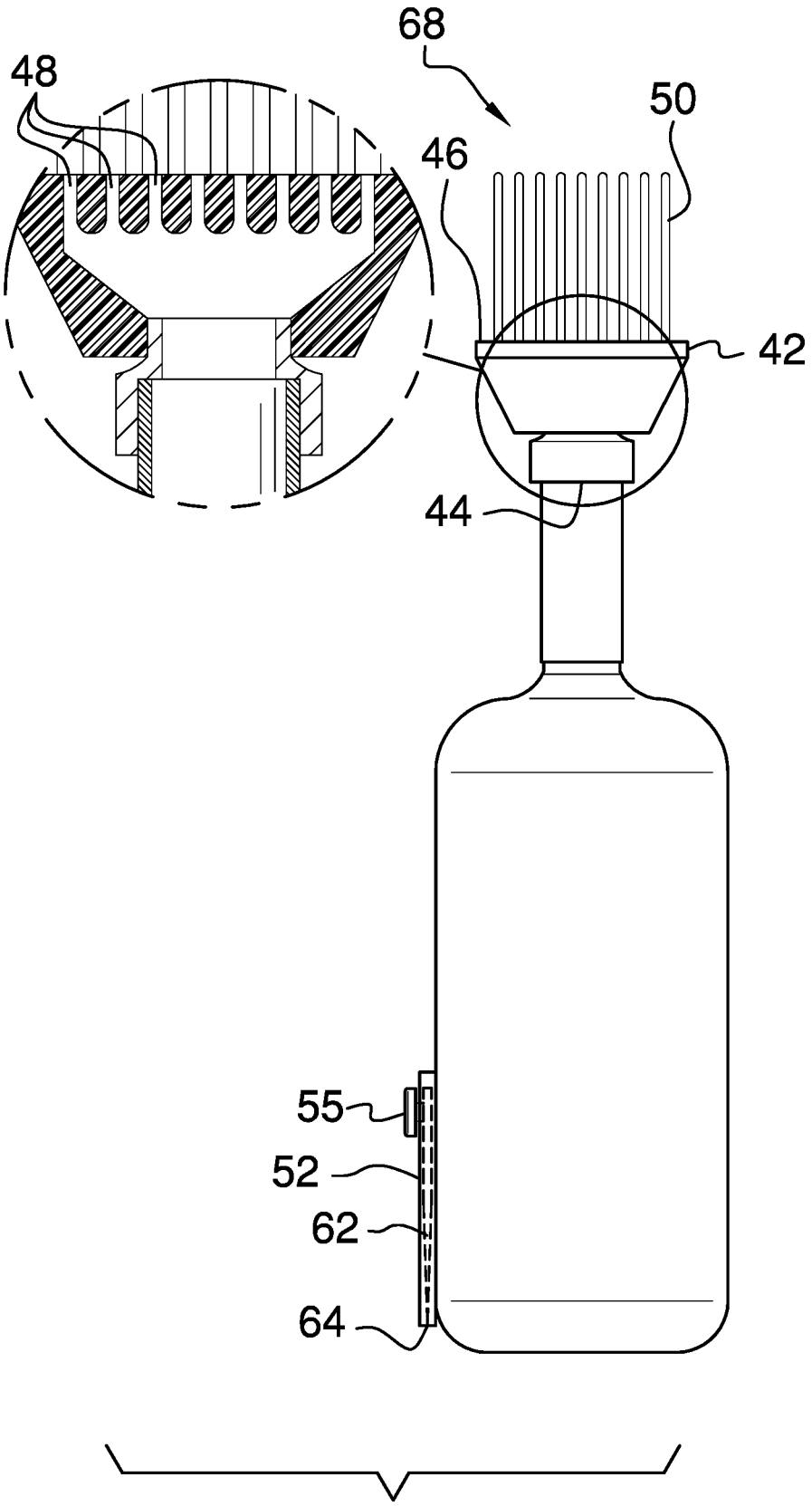
FIG. 5 is a perspective view of an alternative embodiment of the disclosure.

A button 66 is coupled to the pick 62 and the button 66 extends outwardly through the slot 60 in the pick housing 52 to be manipulated by a user. The button 66 urges the pick 62 between the stored and deployed positions when the button 66 is slid upwardly and downwardly in the slot 60. In an alternative embodiment 68 as shown in FIG. 5, the pump 30, switch 38 and power supply 40 may be absent from the pumping unit 24. Additionally, the bottle 12 may be comprised of a resiliently flexible material. In this way the bottle 12 can be squeezed for urging the fluid salon treatment 14 outwardly through the dispensing nozzle 42. Continuing in the alternative embodiment 68, the top end 54 of the pick housing 52 may be open for insertably receiving a comb, other cosmetology tool, for storage.

In use, the bottle 12 is filled with the fluid salon treatment 14, the pumping unit 24 is positioned on the bottle 12 and the dispensing nozzle 42 is positioned on the pumping unit 24. The switch 38 is manipulated to turn on the pump 30, thereby facilitating the pump 30 to pump the fluid salon treatment 14 outwardly through the dispensing nozzle 42. In this way the fluid salon treatment 14 can be applied to the person's hair as the bristles 50 are combed through the user's hair. The button 66 can be slid downwardly in the slot 60 in the pick housing 52 to urge the pick 62 into the deployed position, thereby facilitating the pick 62 to be employed for manipulating hair on the person's head.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A salon chemical dispensing assembly being configured to store and precisely dispense a hair treatment chemical, said assembly comprising:

a bottle for storing a fluid salon treatment;

a pumping unit being removably coupled to said bottle, said pumping unit being in fluid communication with said bottle when said pumping unit is coupled to said bottle wherein said pumping unit is configured to urge the fluid salon treatment outwardly from said bottle when said pumping unit is turned on;

a dispensing nozzle being removably coupled to said pumping unit, said dispensing nozzle being in fluid communication with said bottle when said dispensing nozzle is removably coupled to said pumping unit and when said pumping unit is coupled to said bottle wherein said dispensing unit is configured to have the fluid salon treatment in said bottle pumped into said dispensing nozzle thereby facilitating said dispensing nozzle to dispense the fluid salon treatment;

a plurality of bristles, each of said bristles being coupled to and extending away from said dispensing nozzle;

a pick housing being coupled to said bottle, said pick housing having a top end, a bottom end and a forward wall extending therebetween, said forward wall being distally positioned with respect to said outer wall of said bottle, said bottom end of said pick housing being open, said bottom end of said pick housing being aligned with said bottom end of said bottle, said forward wall having a slot extending into an interior of said pick housing, said slot extending substantially between said top and bottom ends of said pick housing;

a pick being slidably positioned in said pick housing, said pick being positionable in a stored position having said pick being retracted into said pick housing, said pick being positionable in a deployed position having said pick extending outwardly from said pick housing wherein said pick is configured to be inserted between hairs on the person's head, said pick extending from said pick housing such that said pick is parallel to said bristles and extends in a diametrically opposed direction from a direction said bristles extend from said dispensing nozzle; and a button being coupled to said pick, said button extending outwardly through said slot in said pick housing wherein said button is configured to be manipulated by a user, said button urging said pick between said stored and deployed positions when said button is slid upwardly and downwardly in said slot.

2. The assembly according to claim 1, wherein:

said bottle has a neck, a top end, a bottom end and an outer wall, said top end being open into an interior of said bottle; and said pumping unit comprises:

a tube having an upper end and a lower end, said upper end insertably receiving said top end of said bottle;

a pump being positioned within said tube, said pump having an inlet and an outlet; and a pipe being fluidly coupled to said inlet of said pump, said pipe extending downwardly from said tube wherein said pipe is configured to be submerged in the fluid salon treatment when said tube is positioned on said bottle, said pump producing suction in said pipe when said pump is turned on wherein said pump is configured to pump the fluid salon treatment upwardly through said pipe and outwardly through said outlet of said pump.

3. The assembly according to claim 2, wherein said pumping unit further comprises:

a switch being slidably coupled to said tube, said switch being electrically coupled to said pump for turning said pump on and off; and a power supply being positioned within said tube, said power supply being electrically coupled to said switch, said power supply comprising at least one battery.

4. The assembly according to claim 2, wherein:

said dispensing nozzle has a lower end and a top end, lower end being rounded and being open, said dispensing nozzle flaring outwardly between said lower and top ends such that said top end of said dispensing nozzle has an elongated width, said lower end insertably receiving said upper end of said tube such that said lower end is in fluid communication with said outlet of said pump; and said top end of said dispensing nozzle has a plurality of dispensing apertures each extending into an interior of said dispensing nozzle wherein each of said dispensing apertures is configured to have the fluid salon treatment flow outwardly therethrough when said pump is turned on, said dispensing apertures being spaced apart from each other and being arranged into a plurality of rows of dispensing apertures, each of said rows of dispensing apertures extending along an entire width of said top end of said dispensing nozzle.

5. The assembly according to claim 4, further comprising each of said bristles being configured to penetrate hair on a person's head thereby facilitating the fluid salon treatment to be dispensed among the hair on the person's head, each of said bristles being positioned on said top end of said dispensing nozzle, each of said bristles being arranged into a plurality of rows each being interlaced with said plurality of rows of dispensing apertures.

6. The assembly according to claim 1, wherein said pick has a bottom end, said bottom end of said pick tapering to a point, said bottom end of said pick extending outwardly from said bottom end of said pick housing when said pick is positioned in said deployed position.

7. A salon chemical dispensing assembly being configured to store and precisely dispense a hair treatment chemical, said assembly comprising:

a bottle for storing a fluid salon treatment, said bottle having a neck, a top end, a bottom end and an outer wall, said top end being open into an interior of said bottle;

a pumping unit being removably coupled to said bottle, said pumping unit being in fluid communication with said bottle when said pumping unit is coupled to said bottle wherein said pumping unit is configured to urge the fluid salon treatment outwardly from said bottle when said pumping unit is turned on, said pumping unit comprising:

a tube having an upper end and a lower end, said upper end insertably receiving said top end of said bottle;

a pump being positioned within said tube, said pump having an inlet and an outlet;

a pipe being fluidly coupled to said inlet of said pump, said pipe extending downwardly from said tube wherein said pipe is configured to be submerged in the fluid salon treatment when said tube is positioned on said bottle, said pump producing suction in said pipe when said pump is turned on wherein said pump is configured to pump the fluid salon treatment upwardly through said pipe and outwardly through said outlet of said pump;

a switch being slidably coupled to said tube, said switch being electrically coupled to said pump for turning said pump on and off; and a power supply being positioned within said tube, said power supply being electrically coupled to said switch, said power supply comprising at least one battery;

a dispensing nozzle being removably coupled to said pumping unit, said dispensing nozzle being in fluid communication with said bottle when said dispensing nozzle is removably coupled to said pumping unit and when said pumping unit is coupled to said bottle wherein said dispensing unit is configured to have the fluid salon treatment in said bottle pumped into said dispensing nozzle thereby facilitating said dispensing nozzle to dispense the fluid salon treatment, said dispensing nozzle having a lower end and a top end, lower end being rounded and being open, said dispensing nozzle flaring outwardly between said lower and top ends such that said top end of said dispensing nozzle has an elongated width, said lower end insertably receiving said upper end of said tube such that said lower end is in fluid communication with said outlet of said pump, said top end of said dispensing nozzle having a plurality of dispensing apertures each extending into an interior of said dispensing nozzle wherein each of said dispensing apertures is configured to have the fluid salon treatment flow outwardly therethrough when said pump is turned on, said dispensing apertures being spaced apart from each other and being arranged into a plurality of rows extending along an entire width of said top end of said dispensing nozzle;

a plurality of bristles, each of said bristles being coupled to and extending away from said dispensing nozzle wherein each of said bristles is configured to penetrate hair on a person's head thereby facilitating the fluid salon treatment to be dispensed among the hair on the person's head, each of said bristles being positioned on said top end of said dispensing nozzle, each of said bristles being arranged into a plurality of rows each being interlaced with said plurality of rows of dispensing apertures;

a pick housing being coupled to said bottle, said pick housing having a top end, a bottom end and a forward wall extending therebetween, said forward wall being distally positioned with respect to said outer wall of said bottle, said bottom end of said pick housing being open, said bottom end of said pick housing being aligned with said bottom end of said bottle, said forward wall having a slot extending into an interior of said pick housing, said slot extending substantially between said top and bottom ends of said pick housing;

a pick being slidably positioned in said pick housing, said pick being positionable in a stored position having said pick being retracted into said pick housing, said pick being positionable in a deployed position having said pick extending outwardly from said pick housing wherein said pick is configured to be inserted between hairs on the person's head, said pick having a bottom end, said bottom end of said pick tapering to a point, said bottom end of said pick extending outwardly from said bottom end of said pick housing such that pick is parallel to said bristles and extends in a diametrically opposed direction from a direction said bristles extend from said dispensing nozzle when said pick is positioned in said deployed position; and a button being coupled to said pick, said button extending outwardly through said slot in said pick housing wherein said button is configured to be manipulated by a user, said button urging said pick between said stored and deployed positions when said button is slid upwardly and downwardly in said slot.

* * * * *